US006834172B2

(12) United States Patent
Tomita

(10) Patent No.: US 6,834,172 B2
(45) Date of Patent: Dec. 21, 2004

(54) CARRIER HANDLE AND IMAGE FORMING APPARATUS EQUIPPED WITH CARRIER HANDLES

(75) Inventor: Norio Tomita, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/355,224

(22) Filed: Jan. 31, 2003

(65) Prior Publication Data

US 2003/0142993 A1 Jul. 31, 2003

(30) Foreign Application Priority Data

Jan. 31, 2002 (JP) ..... 2002-024072

(51) Int. Cl.[7] ..... G03G 15/00
(52) U.S. Cl. ..... 399/108; 16/429
(58) Field of Search ..... 399/107, 108; 353/17; 312/244; 355/21; 16/421, 429, 430

(56) References Cited

U.S. PATENT DOCUMENTS 3,988,802 A * 11/1976 Bruni et al. ..... 16/429
4,635,010 A * 1/1987 Miyai et al. ..... 399/108
4,748,481 A * 5/1988 Kunihiro ..... 355/133
4,895,231 A * 1/1990 Yamaguchi et al. ..... 190/115
4,951,090 A * 8/1990 Matsumoto et al. ..... 399/13
5,270,772 A * 12/1993 Akiyama ..... 399/110
5,737,667 A * 4/1998 Okuda et al. ..... 399/108

FOREIGN PATENT DOCUMENTS

JP 06222626 A * 8/1994 ..... G03G/15/00
JP 7-140274 A 6/1995
JP 08044272 A * 2/1996 ..... G03G/21/16
JP 08190332 A * 7/1996 ..... G03G/21/16
JP 08305101 A * 11/1996 ..... G03G/15/00
JP 08328329 A * 12/1996 ..... G03G/15/00
JP 09050223 A * 2/1997 ..... G03G/21/16
JP 09212064 A * 8/1997 ..... G03G/21/16
JP 10020601 A * 1/1998 ..... G03G/15/00
JP 11015225 A * 1/1999 ..... G03G/15/00
JP 2000-94790 A 4/2000

* cited by examiner

*Primary Examiner*—Robert Beatty
(74) *Attorney, Agent, or Firm*—Birch, Stewart, Kolasch & Birch, LLP.

(57) ABSTRACT

A carrier handle, which can be accommodated within an apparatus body, with its external end being exposed at an exterior surface of the apparatus body. The handle has a pushee, which comes into sliding contact with a handle pusher formed in the apparatus body. If an external force is applied to the carrier handle while it is accommodated in the apparatus body, the pushee comes into sliding contact with the handle pusher, so that the carrier handle is allowed to project outwardly of the apparatus body.

9 Claims, 7 Drawing Sheets

CARRIER HANDLE AND IMAGE FORMING APPARATUS EQUIPPED WITH CARRIER HANDLES

BACKGROUND OF THE INVENTION

1. Field of the Invention

The present invention relates to a carrier handle to be provided in the body of an image forming apparatus and to serve as means for lifting the apparatus, and an image forming apparatus equipped with a set of such carrier handles.

2. Related Art

An image forming apparatus has a complicated heavy-weight structure. In general, movement of a large-size image forming apparatus (e.g. a console-type apparatus) is enabled by means of casters. On the other hand, the image forming apparatus has a smaller body if the image formation speed is relatively slow or if the apparatus body is separated from peripheral equipment (paper drawer, automatic document feed (ADF), post-processing device, etc.) and combined therewith in use. In many cases, the apparatus body is placed on a paper drawer or other peripheral equipment.

The latter type of image forming system is usually equipped with handles for lifting its body. When not in use, the handles are accommodated inside the body of the image forming apparatus. If the handles are required, a person grips and pulls out each handle by inserting a fingertip into a dent or aperture around the handle.

Nevertheless, dents or apertures around the handles deteriorate external appearance of the image forming system and make it visually unattractive. In an attempt to omit undesirable dents or apertures, use of pop-up type handles (each of which can be unlocked by a pushing action and can spring out by recoiling force of a spring means or the like) is proposed.

The pop-up type handle, however, has its own problems. First, it needs a complex pop-up mechanism (including a releasable lock means as well as a spring or other urging means), which raises the costs for production and assembly. Second, the complicated mechanism is likely to fail for some reasons in the long run.

SUMMARY OF THE INVENTION

The present invention is made to solve these problems. It is an object of the present invention to provide a carrier handle which can project without fail by application of a small external force but which does not require any complex arrangement such as an urging means. Another object of the present invention is to provide an image forming apparatus equipped with a set of such carrier handles. The carrier handle and the image forming apparatus are obtainable by simple arrangements and present good external appearance.

According to the present invention, these objects are achieved by the following arrangements.

(1) In a carrier handle which can be accommodated within a body of an apparatus, with an external end of the handle being exposed at an exterior surface of the apparatus body, the carrier handle comprises a pushee which comes into sliding contact with a handle pusher provided in the apparatus body. This carrier handle is arranged to project outwardly of the apparatus body if an external force is applied to the carrier handle while it is accommodated in the apparatus body, which force allows the pushee to come into sliding contact with the handle pusher and causes the outward projection of the carrier handle from the apparatus body.

According to this arrangement, an external force applied to the carrier handle causes the pushee to come into sliding contact with the handle pusher. As a consequence, the carrier handle is made to project outwardly, without the help of any urging means or complex mechanism. Thus, the carrier handle can do without a noticeable dent or aperture which is indispensable in the prior art in order to pull out a carrier handle. Elimination of the dent or aperture around the handle can enhance visual attractiveness without deteriorating the external appearance.

(2) Another feature of the carrier handle resides in that the handle pusher is a first slope formed in the neighborhood of the exterior surface of the apparatus body, and the pushee is a second slope formed in the neighborhood of the exposed external end of the carrier handle.

This arrangement assures smooth outward projection of the carrier handle with reliability, by bringing the sloped surfaces into sliding contact under an external force. Since the sliding contact between the sloped surfaces is achieved in a simple manner, this arrangement is applicable to the neighborhood of the exterior surface of the apparatus body.

(3) Yet another feature of the carrier handle resides in that the first slope locates on an exterior member which constitutes the exterior surface of the apparatus body, and that the second slope locates on a cap member which covers the external end of the carrier handle.

According to this arrangement, the slopes for causing outward projection of the carrier handle are provided on the exterior member of the apparatus body and on the cap member which covers the external end of the carrier handle. The resistance of sliding contact between the sloped surfaces can be decreased by shaping the cap member from a resin member which may be relatively limited in strength but which has sufficient slidability. As a consequence, projection of the carrier handle can be triggered by a small external force.

(4) Still another feature of the carrier handle resides in that the angle of the first slope is greater than that of the second slope, and that the length of the first slope is shorter than that of the second slope.

According to this arrangement, the second slope on the carrier handle side makes partial contact with the first slope on the exterior member side. The partial contact arrangement decreases the resistance of sliding contact and hence ensures smooth projection of the carrier handle. This arrangement can also minimize the gap between the slopes and improve the external appearance.

(5) An additional feature of the carrier handle resides in further comprising a tab provided at the external end of the carrier handle, wherein the tab slightly projects outwardly of the exterior surface of the apparatus body while the carrier handle is accommodated in the apparatus body.

According to this arrangement, even if the gap around the carrier handle is almost zero, a person can give a small external force by operating the tab with a fingertip. In this manner, the carrier handle can be allowed to project outwardly with good operability.

(6) Another additional feature of the carrier handle resides in further comprising means for restricting extreme projection of the carrier handle outwardly of the apparatus body.

This arrangement can prevent accidental extreme projection of the carrier handle due to vibrations which are generated, for example, during transportation or operation of the apparatus.

(7) An image forming apparatus of the present invention comprises: an image forming part for forming an image on a supplied sheet; a frame for housing the image forming part; and a set of carrier handles each of which is attached to the frame and which can be accommodated within a body of the image forming apparatus, with an external end of each handle being exposed at an exterior surface of the image forming apparatus. In this image forming apparatus, the carrier handle is arranged to project outwardly of the apparatus body if an external force is applied to the carrier handle, which force allows a portion of the carrier handle to come into sliding contact with a portion of the apparatus body in such a manner that the direction of the external force is changed to let the carrier handle project outwardly of the apparatus body, thereby causing the outward projection of the carrier handle from the apparatus body.

According to this arrangement, the image forming apparatus having a complicated heavyweight structure can be equipped with a set of carrier handles which project outwardly of the apparatus body. In contrast to the prior art, the projection action in this apparatus is effected by application of a small external force, without the help of any urging means or complex mechanism. These handles can be provided in a cost effective manner and contribute to improved transportability and easier handling of the apparatus body.

DESCRIPTION OF THE PREFERRED EMBODIMENT

Figure 1:
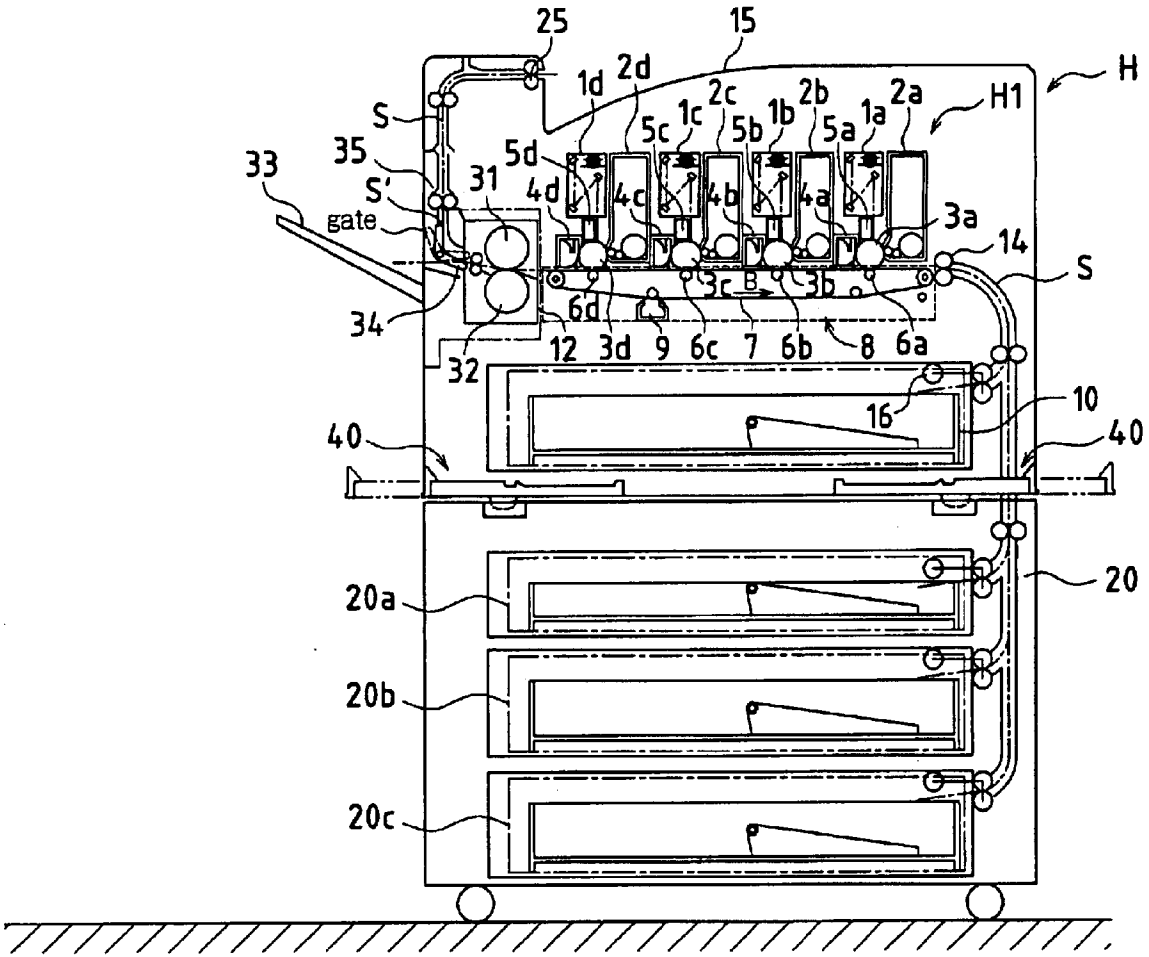
FIG. 1 is an explanatory illustration which shows the structure of the image forming apparatus concerning the embodiment of the present invention.

Referring to the drawings, a detailed description is made below with regard to a carrier handle and an image forming apparatus equipped with such carrier handles concerning the embodiment of the present invention.

<Image Forming Apparatus>

FIG. 1 shows the structure of the image forming apparatus concerning the embodiment of the present invention. This image forming apparatus forms a multicolor or monochromatic image on a certain sheet (recording paper), according to the image data transmitted from an external means. As shown in FIG. 1, the body of the image forming apparatus (hereinafter called "apparatus body H") includes an image forming part H1, a fixing unit 12, a paper transport path S, a feed tray 10, an exit tray 15, etc. The image forming part H1 is composed of exposure units 1, developer devices 2, photosensitive drums 3, charging devices 5, cleaner units 4, and a transfer and transport belt unit 8.

This image forming apparatus processes color data images composed of black (K), cyan (C), magenta (M) and yellow (Y). With respect to these four colors, four latent images are independently formed by four imaging stations each composed of the exposure unit 1 (1*a*, 1*b*, 1*c*, 1*d*), the developer device 2 (2*a*, 2*b*, 2*c*, 2*d*), the photosensitive drum 3 (3*a*, 3*b*, 3*c*, 3*d*), the charging device 5 (5*a*, 5*b*, 5*c*, 5*d*), and the cleaner unit 4 (4*a*, 4*b*, 4*c*, 4*d*). The components labeled a (i.e. 1*a*, 2*a*, 3*a*, 4*a*) constitute the black imaging station. Likewise, the components labeled b, c, d constitute the cyan, magenta and yellow imaging stations, respectively.

The photosensitive drums 3 are disposed (equipped) on approximately in the center of the image forming apparatus. The charging devices 5 are means for uniformly charging the surfaces of the photosensitive drums 3 at a predetermined potential. These charging devices 5 are contact type chargers such as charging rollers, charging brushes, or discharge type chargers (as illustrated). The exposure units 1 employ LED write heads composed of arrays of light-emitting elements, and laser scanning units (LSU, as illustrated) containing laser irradiation sections and reflection mirrors.

The photosensitive drums 3 are charged and exposed in accordance with the image data input, whereby electrostatic latent images which correspond to the image data are formed on the surfaces of the photosensitive drums 3. The developer devices 2 print out, with toners (K, C, M, Y), the electrostatic latent images which are formed on the photosensitive drums 3. After development and image transfer, the cleaner units 4 remove and collect toners which remain on the surfaces of the photosensitive drums 3.

Disposed below the photosensitive drums 3, the transfer and transport belt unit 8 is composed of a transfer belt 7; a driving roller, a tension roller, and a plurality of driven rollers, all for the transfer belt 7; transfer rollers 6 (6*a*, 6*b*, 6*c*, 6*d*); and a transfer belt cleaning unit 9. The transfer belt 7 is stretched about the driving roller, the driven rollers and the tension roller, and is driven by them to rotate in the direction of Arrow B.

The transfer rollers 6 are journaled on an inner frame of an intermediate transfer belt unit (not shown). The transfer rollers 6 hold the transfer belt 7 in the stretched state, together with the driving roller, the driven rollers and the tension roller for the transfer belt 7. The transfer rollers 6 allow toner images on the photosensitive drums 3 to be transferred to a sheet (recording paper) which is transported in a sucked state by the transfer belt 7.

The transfer belt 7 is in contact with all photosensitive drums 3. It functions to form a color toner image (a multicolor toner image) by permitting toner images of respective colors which are formed on the photosensitive drums 3 to be sequentially transferred on the sheet (the recording paper) The transfer belt 7 is an endless belt made of a film with a thickness of about 100 $\mu$m.

The transfer rollers 6 touch the reverse side of the transfer belt 7 and effect transfer of toner images from the photosensitive drums 3 to the sheet (recording paper). To transfer toner images, high voltage of positive polarity, which is opposite to the charge polarity of the toner (negative), is applied to the transfer rollers 6. Each transfer roller has a metal shaft (e.g. of stainless steel) in a diameter of 8 to 10 mm and a surface made of a conductive elastic material (e.g. of EPDM, urethane foam). The conductive elastic material enables uniform application of high voltage to the recording paper (sheet).

Incidentally, toners deposited on the transfer belt 7 from the photosensitive drums 3 contaminate the reverse side of the recording paper. To prevent this problem, the transfer belt cleaning unit 9 is set to remove and collect any deposited toners.

The feed tray 10 holds sheets (recording paper) to be printed and is disposed under the image forming part of the image forming apparatus. The exit tray 15 is provided at the top of the image forming apparatus to receive printed sheets face down. In addition, an exit tray 33 locates on one side of the image forming apparatus to receive printed sheets face up.

The image forming apparatus also includes an S-shape sheet transport path S for guiding sheets from the feed tray 10, via the transfer and transport unit 8 and the fixing unit 12, to the exit tray 15. Along the paper transport path S which continues from the feed tray 10 to the exit trays 15, 33, there are a pickup roller 16, a pair of resist rollers 14, the fixing unit 12, a transport direction switch gate 34, some pairs of transport rollers 25, and others.

The transport rollers 25 are small rollers for activating and assisting transportation of sheets. The transport rollers 25 are provided at some positions along the paper transport path S. The pick-up roller 16 at the exit end of the feed tray 10 is a draw-in roller, with which sheets are supplied one by one from the feed tray 10 into the paper transport path S.

The transport direction switch gate 34 is attached to a side cover 35 in a swingable manner. Referring to FIG. 1, when the gate 34 is turned from the solid line position to the broken line position, the gate 34 diverts a sheet from the transport path S to the side exit tray 33. When the gate 34 is in the solid line position, a sheet which comes out from the fixing unit 12 is directed into a transport section S' (part of the paper transport path S) between the side cover 35 and the transport direction switch gate 34, and is finally ejected to the top exit tray 15.

The resist rollers 14 temporarily retain a sheet which passes through the paper transport path S, before the image forming unit H1. These rollers 14 serve to time the feed of a sheet with rotation of the photosensitive drums 3, so that each toner image can be effectively transferred from the corresponding photosensitive drum 3 onto the sheet.

Specifically, the resist rollers 14 are timed to feed a sheet such that the start of the toner image on each photosensitive drum 3 is in registry with the start of the print range in the sheet, based on a detection signal outputted from the detection switch (not shown) which locates upstream of the resist rollers.

The fixing unit 12 contains, among others, a heat roller 31 and a pressure roller 32, which guide a sheet in a squeezed manner as they rotate. The heat roller 31 is set at a proper fixing temperature by a control unit (not shown), based on a detected temperature. The heat roller 31 thermally presses the sheet in cooperation with the pressure roller 33, in order that the toner images of multiple colors which have been transferred on the sheet can melt, mix and press-contact with each other and finally be heat-fused on the sheet.

After the toner images of multiple colors are fixed, the sheet is guided into the face-down exit path (exit part) of the paper transport path S by pairs of the transport rollers 25, and is ejected to the exit tray 15 in the reversed state (with the multicolor toner image facing down). Incidentally, it should be noted that the foregoing description is applicable not only to a color image forming apparatus, but also to a monochromatic image forming apparatus which has only one image forming station.

<Paper Drawer Unit>

A paper drawer unit 20 may be optionally added to the apparatus body H. The paper drawer unit 20 usually has a feed tray or trays for containing sheets, so that various types of recording sheets can be stored in advance. The illustrated paper drawer unit 20 includes three feed trays 20*a*, 20*b*, 20*c*.

The type of paper drawer unit 20 can be selected from several varieties including a three-drawer unit (as illustrated), a shallow one-drawer unit, a two- or four-drawer unit and the like, according to the customer's intended use, budget, etc.

The top panel of the paper drawer unit 20 is provided with holes for receiving rubber feet of the apparatus body H. When the apparatus body H is mounted on the paper drawer unit 20, its feet are fitted in these holes, so that the apparatus body H rests in tight contact with the paper drawer unit 20. With hardly any space between them, the image forming system presents a neat appearance.

<Carrier Handles>

The apparatus body H which rests on the paper drawer unit 20 is equipped with two pairs of carrier handles 40 at the bottom of the apparatus body H (Of the four handles, two are located on the right side and the other two are located on the left side). When necessary, two or more persons can hold these carrier handles 40 on both sides of the apparatus body H in order to move the apparatus body H.

Figure 6:
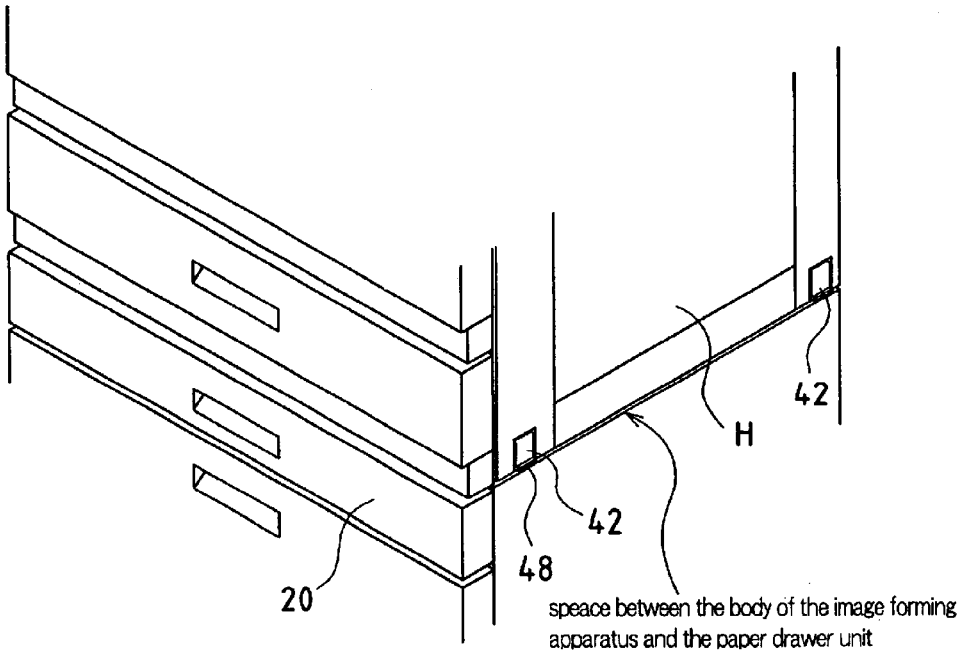
FIG. 6 is a partial perspective view of the image forming system concerning the present invention.

When not in use, these carrier handles 40 are accommodated in the apparatus body H so as not to impair its external appearance (visual attractiveness and design). In the accommodated state, the external end of each handle 40 forms a level surface with the cabinet 51 of the apparatus body H, with a tab 48 projecting about 2 mm from the surface. The tab 48, to be detailed later, enables a user to put his fingertip in order to pull out the handle as required (see FIG. 6).

Figure 2:
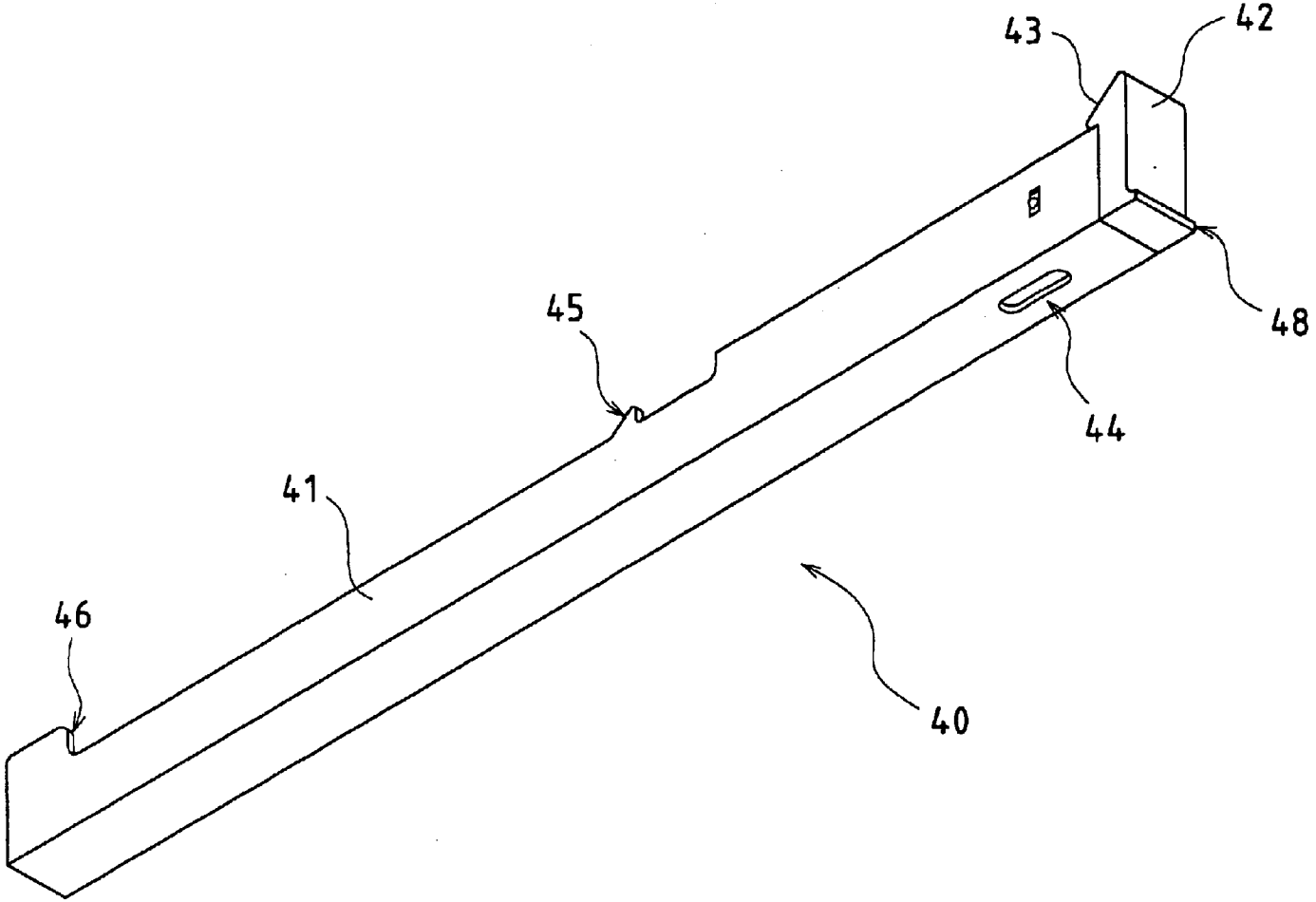
FIG. 2 is a perspective view of the carrier handle concerning the embodiment of the present invention.

Referring to FIG. 2, the body 41 of each handle 40 is made of a sheet metal (thickness t: 1.6 mm). To increase the strength, the material is bent to define a near U-shaped section. A grip 41*a* to be held by a hand is shaped into a four-sided pipe so as to fit well in the hand. Further, a resin handle cap (a cap member) 42 covers the external end of the handle body 41 to protect the hand against injury.

In the handle cap 42, the upper portion includes an inward second slope (called a "pushee", as a part to be pushed) 43, and the front face has a tab 48 which projects at the bottom. Near the handle cap 42, an elongated stopper slot 44 is formed in the bottom 47 of the handle body 41. The handle body 41 is also provided with locking parts 45, 46 which project upwardly from the upper edge in the middle part and rear part, respectively.

Figure 3:
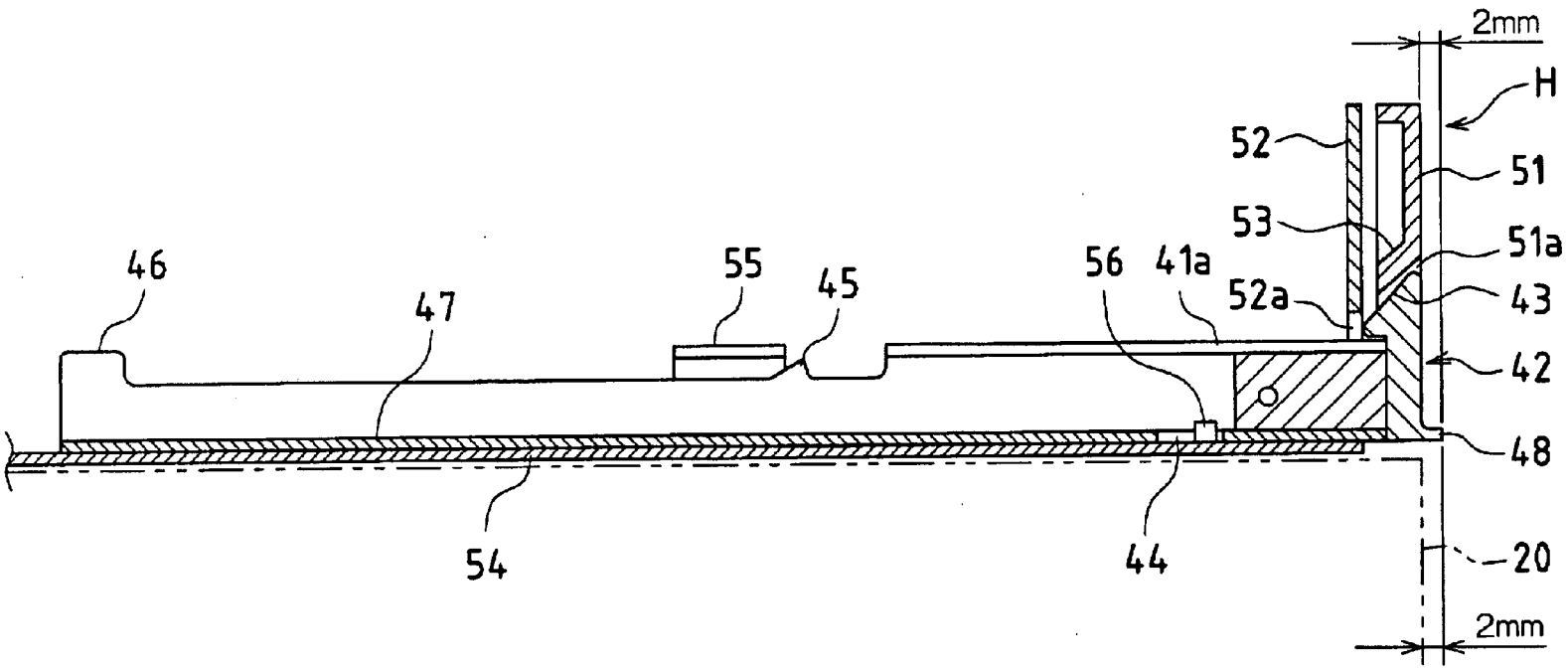
FIG. 3 is a section view which shows the carrier handle as accommodated in the apparatus body.

Turning next to FIG. 3, the carrier handle 40 of this structure is inserted in the apparatus body H from openings 51*a*, 52*a* which penetrate a cabinet 51 and a frame 52 of the apparatus body H. In the state where the carrier handle 40 is accommodated, the front face of the handle cap 42 is exposed from the opening 51*a* and forms a level surface with the cabinet 51, and the handle body 41 rests on a bottom frame 54 and is slidable in a pull-out direction.

In this accommodated state, there is hardly any gap between the front face of the handle cap 42 and the opening 51*a* in the cabinet 51 (the gap is not greater than 1 mm, and 0.75 mm in this embodiment), which assures natural nice appearance. In terms of design, the side exterior panels of the apparatus body H are level with the side faces of the paper drawer unit 20. In addition, the space at the boundary between the apparatus body H and the paper drawer unit 20 is as little as a few millimeters or almost zero (see FIG. 6).

Besides, the second slope 43 of each carrier handle 40 is closely face to face with an outward first slope 53 of the cabinet 51 which locates above the opening 51*a*. A storage stopper 56 which projects from the bottom frame 54 of the cabinet 51 loosely fits in the stopper slot 44.

As means for setting the pull-out limit of the carrier handle 40, a pull-out stopper 55 is formed laterally, approximately at the lower central part in the frame 52 of the apparatus body H. In association with the movement of the carrier handle 40, the relative position of the pull-out stopper 55 changes between the locking parts 45, 46 of the handle body 41. In the accommodated state, the stopper 55 stays in the neighborhood of the first locking part 45.

Figure 4A:
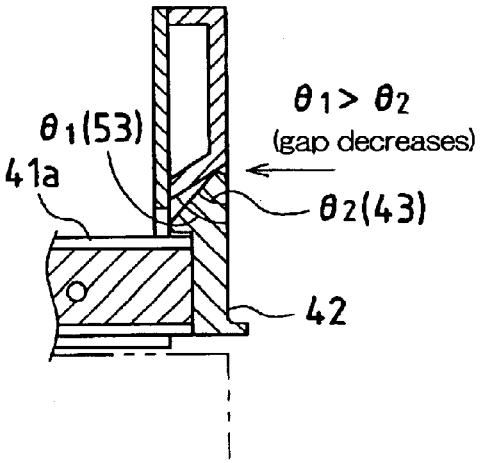
FIG. 4(*a*) and FIG. 4(*b*) are explanatory illustrations of slopes which are related to the carrier handle.
Figure 4B:
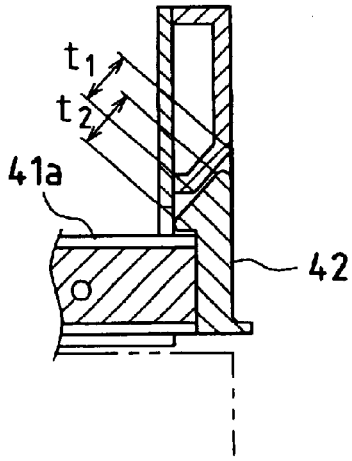

Next, FIG. 4(*a*) and FIG. 4(*b*) represent details of the first slope 53 and the second slope 43. They need to satisfy the conditions that the first slope angle $\theta_1$ is greater than the second slope angle $\theta_2$, and that the first slope length $t_1$ is shorter than the second slope length $t_2$. Preferably, the first slope angle $\theta_1$ is in the range of 40° to 55° (45° in this embodiment) and the second slope angle $\theta_2$ is in the range of 30° to 45° (38° in this embodiment)

Figure 7:
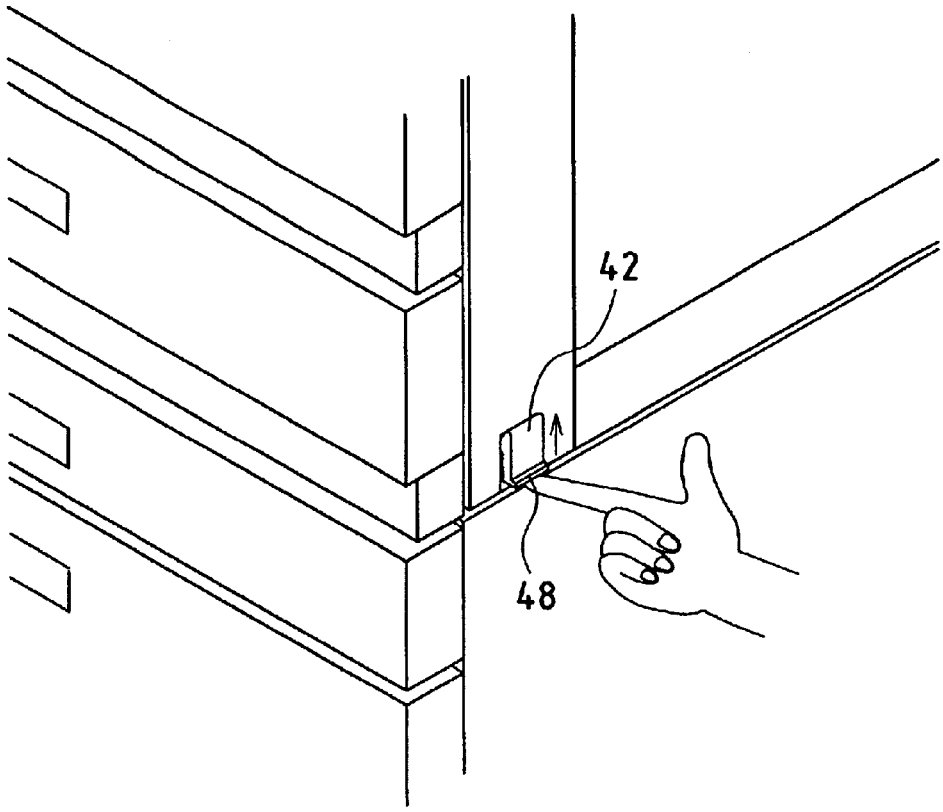
FIG. 7 is a partial perspective view of the image forming system concerning the present invention, shown with a fingertip on the tab.

In this embodiment, the second slope 43 is formed on the handle cap 42 which is made of a resin material with good slidability. The resin member reduces the resistance of sliding contact against the first slope 53 and ensures efficient projection actions. Specifically, the projection action is effected by a fingertip operation of pushing up the tab 48 of the carrier handle 40 (see FIG. 7). Then, the second slope 43 comes into sliding contact with the first slope 53, at which moment the upward external force is changed into a horizontal force which lets the carrier handle 40 project outwardly of the apparatus body H. As a result, the carrier handle 40 projects smoothly out of the apparatus body H.

At the initial stage of this projection action, extreme projection of the carrier handle 40 is prohibited by the storage stopper 56 of the cabinet 51 which loosely fits in the stopper slot 44. The storage stopper 56 also avoids accidental projection of the carrier handle 40 due to vibration or the like. To give an alternative structure, the storage stopper 56 may be provided on the carrier handle 40, and the stopper slot 44 may locate in the bottom frame 54 of the cabinet 51.

Figure 5:
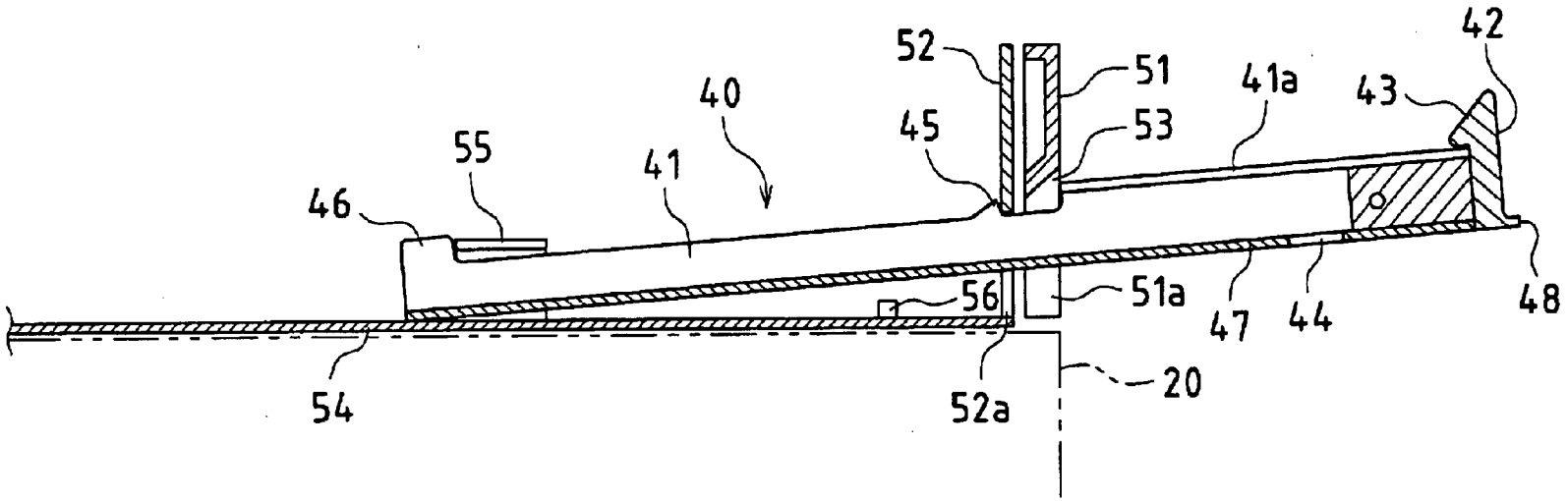
FIG. 5 is a section view in which the carrier handle is pulled out to the limit.

The carrier handle 40 can project as far as the pull-out limit where the second locking part 46 is hooked at the pull-out stopper 55 of the apparatus body H (see FIG. 5). To lift the apparatus body H, a person only needs to pull out each of the carrier handles 40 to the pull-out limit and to hold the grip 41*a*.

While the apparatus body H is raised, the carrier handles 40 function as levers for the apparatus body H, so that the apparatus body H can be lifted in a stable manner despite its considerable weight (about 60 kg). As illustrated in FIG. 5, the first locking part 45 of each carrier handle 40 is hooked at the periphery of the opening 52*a* in the frame 52, whereas the second locking part 46 is hooked at the pull-out stopper 55 of the apparatus body H. Besides, the internal end of the handle body 41 abuts the bottom frame 54 of the cabinet 51. Owing to the three-point-contact (hooked or abutted) between the carrier handle 40 and the apparatus body H, it is possible to lift the apparatus body H in a stable manner, with a load being borne by the frame 52 and the bottom frame 54 which have sufficient strength.

Therefore, a small external force applied to the carrier handle 40 (an upward force in this embodiment) causes the pushee 43 to come into sliding contact with the handle pusher 53 of the apparatus body H. As a consequence, the carrier handle 40 is made to project outwardly, without the help of any urging means or complex mechanism. Thus, the carrier handle of this embodiment can do without a noticeable dent or aperture which is indispensable in the prior art in order to pull out a carrier handle. Elimination of the dent or aperture around the handle can enhance visual attractiveness without deteriorating the external appearance.

With respect to the arrangement of bringing the sloped surfaces into sliding contact, it also assures smooth outward projection of the carrier handle 40 with reliability. Since the sliding contact between the sloped surfaces is achieved in a simple manner, this arrangement is applicable to the neighborhood of the exterior surface of the apparatus body H, without restricting other layouts.

As already mentioned, the first slope 53 is formed at the exterior member (the cabinet) 51 which constitutes the exterior surface of the apparatus body H and the second slope 43 is provided on the cap member (the handle cap) 42 which covers the external end of the carrier handle 40. The first slope 53 is made of metal to impart the strength, whereas the handle cap 42 is a resin member which may be relatively limited in strength but which has sufficient slidability. Since this combination decreases the resistance of sliding contact between the sloped surfaces, smooth projection of the carrier handle 40 can be triggered by a small external force.

Further, the first slope 53 and the second slope 43 are designed such that the first slope angle $\theta_1$ is greater than the second slope angle $\theta_2$, and that the first slope length $t_1$ is shorter than the second slope length $t_2$. According to this design, the second slope 43 makes partial contact with the first slope 53 (see FIG. 4(*a*)), which further decreases the resistance of sliding contact and ensures smooth projection of the carrier handle 40. In comparison with the case of FIG. 4(*b*) where the slope angles $\theta_1$, $\theta_2$ are equal, the above-defined design can minimize the exterior gap between the slopes 43, 53 and improve the external appearance (see also FIG. 4(*a*), FIG. 6 and FIG. 7).

As for the tab 48 which locates at the external end of the carrier handle 40, the tab 48 projects slightly relative to the cabinet 51 while the carrier handle 40 is accommodated in the apparatus body H. Even if the gap around the carrier handle 40 is almost zero, a person can easily give an external force by operating the tab 48 with a fingertip. In this manner, the carrier handle 40 can be allowed to project outwardly with good operability.

In addition, the storage stopper 56 functions as means for restricting an extreme projection action of the carrier handle 40 out of the apparatus body H. The storage stopper 56 can prevent accidental extreme projection of the carrier handle 40 due to vibrations which are generated, for example, during transportation or operation of the image forming apparatus.

According to the present invention, the image forming apparatus having a complicated heavyweight structure can be equipped with a set of inventive carrier handles 40 which project outwardly of the apparatus body H. In contrast to the prior art, the projection action in this apparatus is effected by application of a small external force, without the help of any urging means or complex mechanism. The handles 40 can be provided in a cost effective manner and contribute to improved transportability and easier handling of the apparatus body H.

It should be understood that the structure shown in FIG. 1 does not limit the image forming apparatus of the present invention. As a matter of fact, present invention is applicable to a relatively heavy image forming apparatus of any type or structure which can at least rest on an optional device or other mounting stand.

The invention may be embodied in other specific forms without departing from the spirit or essential characteristics thereof. The above embodiments are therefore to be considered in all respects as illustrative and not restrictive, the scope of the invention being indicated by the appended claims rather than by the foregoing description. All changes which come within the meaning and range of equivalency of the claims are therefore intended to be embraced therein.

This application is based on Patent Application No. 2002-024072 filed in Japan, the contents of which are incorporated hereinto by reference. Likewise, the contents of all references cited herein are incorporated hereinto by reference.

What is claimed is:

1. A carrier handle which can be accommodated within a body of an apparatus, with an external end of the handle being exposed at an exterior surface of the apparatus body, the carrier handle comprising a pushee with a sloped surface comes into sliding contact with a handle pusher provided in the apparatus body, and the carrier handle being arranged to project outwardly of the apparatus body if an external force is applied to the carrier handle while it is accommodated in the apparatus body, which force allows the pushee to come into sliding contact with the handle pusher and causes the outward projection of the carrier handle from the apparatus body.

2. A carrier handle according to claim 1, wherein the handle pusher is a first slope formed in the neighborhood of the exterior surface of the apparatus body, and the pushee is a second slope formed in the neighborhood of the exposed external end of the carrier handle.

3. A carrier handle according to claim 2, wherein the first slope locates on an exterior member which constitutes the exterior surface of the apparatus body, and the second slope locates on a cap member, which covers the external end of the carrier handle.

4. A carrier handle according to claim 3, wherein the angle of the first slope is greater than that of the second slope, and the length of the first slope is shorter than that of the second slope.

5. A carrier handle according to claim 1, which further comprises a tab provided at the external end of the carrier handle, wherein the tab slightly projects outwardly of the exterior surface of the apparatus body while the carrier handle is accommodated in the apparatus body.

6. A carrier handle according to claim 2, which further comprises means for restricting extreme projection of the carrier handle outwardly of the apparatus body.

7. An image forming apparatus which comprises:

an image forming part for forming an image on a supplied sheet;

a frame for housing the image forming part; and a set of carrier handles each of which is attached to the frame and which can be accommodated within a body of the image forming apparatus, with an external end of each handle being exposed at an exterior surface of the image forming apparatus, the carrier handle being arranged to project outwardly of the apparatus body if an external force is applied to the carrier handle, which force allows a portion of the carrier handle which includes a slope to come into sliding contact with a portion of the apparatus body that includes a slope in such a manner that the direction of the external force is changed to let the carrier handle project outwardly of the apparatus body, thereby causing the outward projection of the carrier handle from the apparatus body.

8. A carrier handle according to claim 2, which further comprises a tab provided at the external end of the carrier handle, wherein the tab slightly projects outwardly of the exterior surface of the apparatus body while the carrier handle is accommodated in the apparatus body.

9. A carrier handle according to claim 3, which further comprises means for restricting extreme projection of the carrier handle outwardly of the apparatus body.

* * * * *